US009067458B1

(12) United States Patent
Mock

(10) Patent No.: US 9,067,458 B1
(45) Date of Patent: Jun. 30, 2015

(54) WRITING INSTRUMENT

(71) Applicant: Craig C. Mock, Dodge City, KS (US)

(72) Inventor: Craig C. Mock, Dodge City, KS (US)

( * ) Notice: Subject to any disclaimer, the term of this patent is extended or adjusted under 35 U.S.C. 154(b) by 0 days.

(21) Appl. No.: 14/053,138

(22) Filed: Oct. 14, 2013

(51) Int. Cl.
*B43K 23/00* (2006.01)
*B43K 23/008* (2006.01)
*B25G 1/10* (2006.01)

(52) U.S. Cl.
CPC ..... *B43K 23/00* (2013.01); *B43K 23/008* (2013.01); *B25G 1/102* (2013.01)

(58) Field of Classification Search
USPC ..... 401/6, 88, 110, 112
See application file for complete search history.

(56) References Cited

U.S. PATENT DOCUMENTS

| | | | | |
|---|---|---|---|---|
| D780,599 | | 1/1905 | Cypert | |
| 1,367,872 | A * | 2/1921 | Glaesser | 401/6 |
| 2,845,047 | A | 7/1958 | McKendree | |
| D260,533 | S | 9/1981 | Azuma | |
| 4,302,121 | A | 11/1981 | Kim | |
| 4,508,464 | A * | 4/1985 | Money | 401/6 |
| 4,568,213 | A * | 2/1986 | Money | 401/6 |
| D286,650 | S | 11/1986 | Fischer | |
| 4,689,020 | A | 8/1987 | Rusk | |
| 4,815,880 | A | 3/1989 | Sekiguchi | |
| 4,991,985 | A | 2/1991 | Laipply | |
| 5,413,428 | A * | 5/1995 | Kageyama | 401/110 |
| 6,328,493 | B1 | 12/2001 | Starchevich | |
| 6,464,419 | B1 * | 10/2002 | Chan | 401/131 |
| 6,554,515 | B2 | 4/2003 | Debbas | |
| 6,648,536 | B1 | 11/2003 | Bellue | |
| 7,316,516 | B2 | 1/2008 | Regala | |
| 8,043,686 | B2 | 10/2011 | Suzuki et al. | |
| 2010/0074669 | A1 | 3/2010 | Liu | |

FOREIGN PATENT DOCUMENTS

| | | |
|---|---|---|
| DE | 3801333 | 8/1988 |

* cited by examiner

*Primary Examiner* — David Walczak
(74) *Attorney, Agent, or Firm* — Kenneth H. Jack; Davis & Jack, L.L.C.

(57) ABSTRACT

A writing instrument comprising a tubular body having an upper end, a lower end having left and right sides, and a point end; left and right wings, each wing among the left and right wings having proximal and distal ends; hinges interconnecting the left and right wings and the tubular body, the hinges respectively positioning the left and right wings' proximal ends at the left and right sides of the tubular body's lower end, and the hinges being adapted for respectively leftwardly and rightwardly extending the left and right wings' distal ends; and a ballpoint pen assembly operatively associated with the tubular body's point end.

8 Claims, 2 Drawing Sheets

WRITING INSTRUMENT

FIELD OF THE INVENTION

This invention relates to writing instruments such as pens and pencils. More particularly, this invention relates to such writing instruments whose body portions are adapted for ergonomic grasping and holding by the fingers of a writer's hand.

BACKGROUND OF THE INVENTION

Common pens and pencils having a barrel shaped or cylindrical body are often grasped by the thumb, index, and middle fingers of a writer's hand. During such use, the tip of the index finger, the tip of the thumb, and the proximally lateral side of the writer's middle finger are typically placed over contact points arrayed at approximately 120° intervals about the cylindrical body of the instrument. Such common writing instrument holding technique, when applied to a common cylinder bodied pen, often undesirably and unergonomically allows the body of the pen to roll over the contact points resulting in undesirable pen instability during writing.

The instant inventive writing instrument solves or ameliorates the problems, difficulties, and deficiencies of common barrel bodied pens and pencils, described above, by specially configuring the pen's body to define a pair of wide "V" channels or valleys for secure and ergonomic receipts of and holding of a writer's thumb tip and index finger tip, and to further include a broad flat undersurface for secure contact with the side of the writer's middle finger, such valleys and undersurface being defined by an upwardly extending tubular body and by left and right wings extending from a lower aspect of the tubular body.

BRIEF SUMMARY OF THE INVENTION

A first structural component of the instant inventive writing instrument comprises a tubular body having an upper end, a lower end having left and right sides or edges, and having a point or writing end. In a preferred embodiment, the tubular body is composed of durable injection molded plastic. Suitably, the tubular body component may be alternatively composed of a metal such as silver, aluminum, brass, or steel, or the tubular body may be composed of a fine grain wood such as rose wood.

Further structural components of the instant inventive writing instrument comprise left and right wings, each wing preferably having proximal and distal ends. The left and right wing components may be suitably composed of any of the tubular body material choices referenced above.

Structural components of the instant inventive writing instrument comprise mounting means which interconnect the left and right wings and the tubular body, respectively positioning the left and right wings' proximal ends at the left and right sides of the tubular body's lower end, and respectively leftwardly and rightwardly extending the left and right wings' distal ends. In a suitable embodiment, the mounting means may comprise rigid attachments or whole formations of the left and right wings' proximal ends with the tubular body. However, for purposes of compact storage, the mounting means may be adapted for downward pivoting movement of at least a first wing among the left and right wings with respect to the tubular body. Preferably, the mounting means facilitate downward pivoting movement of both of the wings.

Provided that the selected mounting means facilitate the preferred downward pivoting movements of the left and right wings with respect to the tubular body, the inventive writing instrument is advantageously capable of assuming a compact or flattened configuration which is easily stacked and packed for shipping, easily stored within boxes, easily displayed for sale, and may be unobtrusively inserted into and retained within the substantially flat interior space of a shirt pocket. Where the mounting means facilitate the pivoting downward movement of the left and right wings, such means preferably comprise left and right hinges which are integrally incorporated within and formed as a part of the proximal ends of the left and right wings and the lower end of the tubular body.

A further structural component of the instant inventive writing instrument comprises scribing means which are operatively associated with the tubular body's point end. The instant invention's scribing means may suitably constitute a drawing implement selected from the group consisting of fixed ballpoint pen assemblies, mechanically extendable and retractable ballpoint pen assemblies, fixed felt tip pen assemblies, mechanically extendable and retractable felt tip pen assemblies, fixed graphite pencil assemblies, and mechanical pencil assemblies. Any of such common writing and drawing assemblies may suitably be mounted within the hollow interior of the instrument's tubular body for exposure of a pen point or pencil point, as the case may be, from the instrument's point end. In a preferred embodiment, the scribing means comprise a cam and compression spring actuated extendable and retractable ballpoint pen assembly which exposes a thumb click actuator button oppositely from the tubular body's point end. Other commonly known ballpoint pen actuator mechanisms such as turn screw actuators and sliding latch actuators are considered to fall within the scope of the invention.

In use of the instant inventive writing assembly, and assuming provisions and incorporations of the preferred structures described above, a writer may initially pivot the instrument's left and right wings to their leftwardly and rightwardly extended positions. Such initial manipulation advantageously forms left and right valleys or "V's" along the body. Such valleys facilitate secure receipts of the writer's index finger tip and thumb tip, and form a broad flat undersurface for secure contact with the lateral aspect of the writer's middle finger. Upon such secure and ergonomic writing instrument grasping, the writer may utilize the instrument for secure and steady writing. Upon completion of writing, the instrument's left and right wings may be manually pivoted to their downwardly extended positions, configuring the instrument for compact storage at a location such as the writer's shirt pocket.

Accordingly, objects of the instant invention include the provision of a writing instrument which incorporates structures, as described above, and which arranges such structures in relation to each other in manners described above for the achievement of the functions, benefits, and advantages, as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
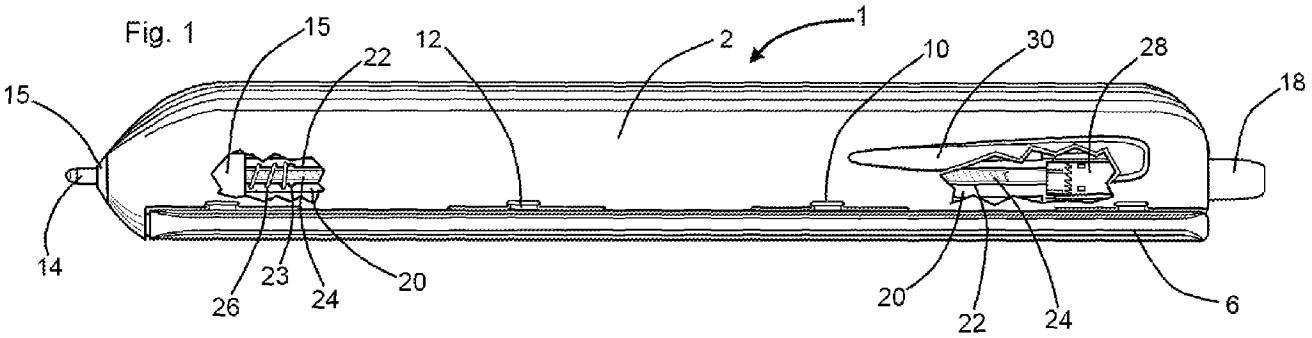
FIG. 1 is a side view of the instant inventive writing instrument, the view showing tubular body side wall "cut aways" for views of interior structures.
Figure 2:
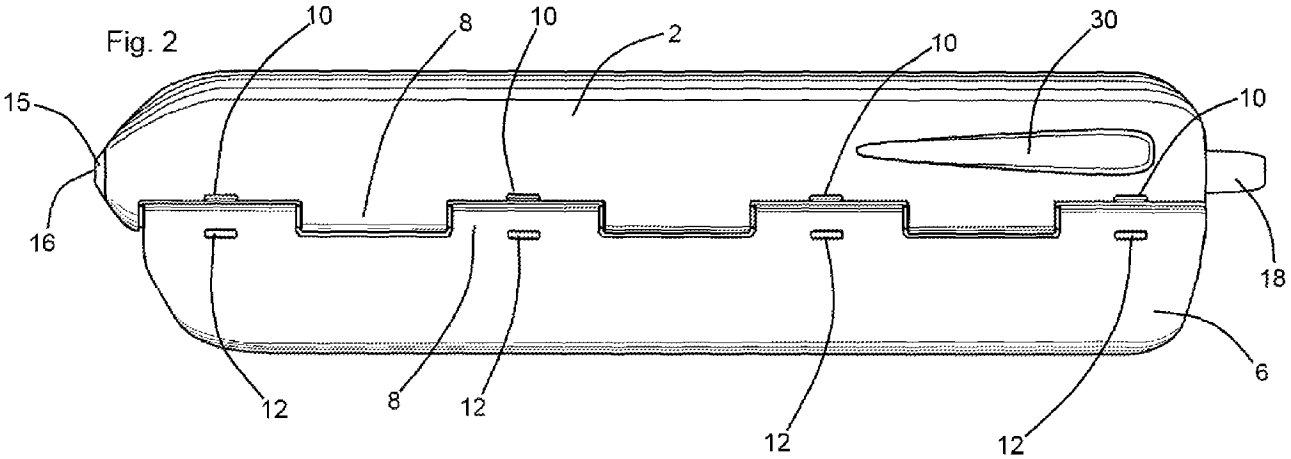
FIG. 2 redepicts the writing instrument of FIG. 1, the view of FIG. 2 showing a ballpoint assembly retracted and showing wing components downwardly pivoted.
Figure 3:
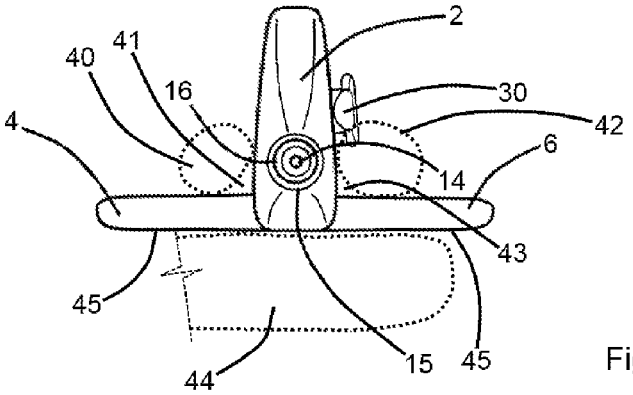
FIG. 3 is a point end view of the structure of FIG. 1, the view showing a writer's fingers in dotted lines.

Referring now to the drawings and in particular to Drawing FIGS. 1 and 2, a preferred embodiment of the instant inventive writing instrument is referred to generally by Reference Arrow 1. The writing instrument 1 has a tubular body 2 having a leftward (according to view) point end, a rightward button actuator end, having upper and lower ends. Referring further to FIG. 3, the instant inventive writing instrument further comprises right and left wings 4 and 6 whose proximal ends are respectively fixedly attached to the lower right and left sides of the tubular body 2. The proximal ends of the instrument's wings 4 and 6 are preferably attached to the right and left aspects of the lower end of the tubular body by hinges 8 which are preferably integrally formed as parts of the proximal ends of the wings 4 and 6, and the lower edges of the tubular body 2.

Figure 4:
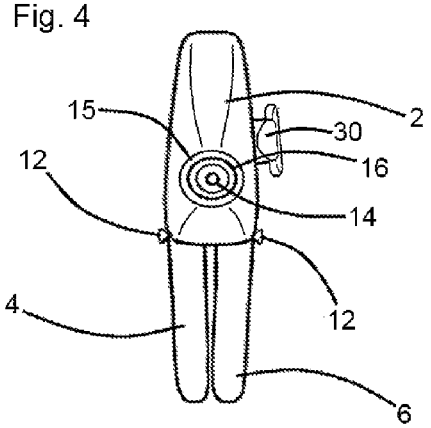
FIG. 4 is a point end view of the structure of FIG. 2.
Figure 5:
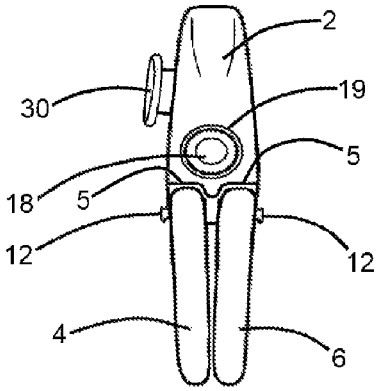
FIG. 5 is a reverse view of the structure of FIG. 4.

As indicated in FIG. 2, the hinges 8 preferably comprise longitudinally extending series of snap lug 12 and snap channel or socket 10 fasteners which upon engagement releasably resist counter-pivoting movements of the wings 4 and 6 from their FIGS. 1 and 3 position to their FIGS. 2, 4, and 5 position. Pivot stopping surfaces 5 of the hinges 8 oppositely resist upward pivoting motions of the wings 4 and 6 with respect to the body 2 at the inverted "T" configuration of FIG. 3.

Referring to FIGS. 1 and 3, the tubular body 2 preferably houses and deploys scribing means. As depicted, a preferred scribing means comprises an assembly including tubular plastic cartridge 22 which extends along and within a tubular channel 20 within body 2, such cartridge 22 containing and dispensing ink 24. The point end of the cartridge 22 terminates at a ballpoint assembly 14,16, which is received and supported for reciprocating motion within the point end of the housing 2 by means of an inserted and pressure fitted needle or cannulae component 15. The ballpoint 14,16 and cartridge 22 are normally biased oppositely from the body's point end by means of a coaxially mounted compression spring 26 which spans between cannulae 15 and cartridge side wall stops 23. A thumb click type cam actuator 28 housed at the opposite end of the cartridge 22 for reciprocating and incremental cam actuated rotating motion operatively extends and retracts the ballpoint 14 within the cannulae 15 upon successive depressions and reciprocating motions of actuator button 18 within button channel 19.

The cam and compression spring actuated extendable and retractable ballpoint pen assembly depicted in FIG. 1 is intended as being representative of other suitably employed scribing means such as fixed ballpoint pen assemblies, fixed felt tip pen assemblies, mechanically extendable and retractable felt tip pen assemblies, fixed graphite pencil assemblies, and mechanical pencil assemblies, any of which may be suitably housed within and deployed by the body 2, and each of which falls within the scope of the instant invention.

In use of the instant inventive writing instrument, and referring to Drawing FIGS. 2, 4, and 5, a writer may initially grasp body portion 2 with one hand and may laterally or rightwardly and leftwardly splay the wings 4 and 6 away from each other until the proximal ends of the upper surfaces of wings 4 and 6 contact and stop against stop surfaces 5. Substantially simultaneously with such wing pivot stopping contacts, snap lugs 12 snap into engagements within snap sockets 10 for resisting any premature and unwanted counter-pivoting of the wings 4 and 6.

Thereafter, referring in particular to FIG. 3, the writer may grasp the instrument in his or her (for example) right hand, causing index finger 40 to rest and be supported within valley or "V" 41, causing thumb tip 42 to be similarly supported within valley or "V" 43, and causing the lateral aspect of middle finger 44 to rest and support against the broad and flat undersurface 45 of the instrument. Just as the inside diameter of the "O" of a common "OK" hand signal is between ¾" and 1½", the "wing span" or distance between distal ends of wings 4 and 6 of the instant inventive instrument is preferably between ¾" and 1½', such sizing assuring that ergonomic finger grasping as described above may be performed comfortably. Upon grasping of the instrument in the manner of FIG. 3, secure, stable, and ergonomic support of the instrument within the writer's hand is achieved.

Following completion of writing, the writer may downwardly depress or counter-pivot wings 4 and 6, causing such wings to disengage snap fasteners 10,12, and to re-extend downwardly to the compact storage configuration of FIGS. 4 and 5. Thereafter, and assuming that button 18 has been actuated to retract ballpoint 14,16, the writing instrument 1 may be conveniently and compactly stored within the writer's shirt pocket. Pocket clip 30 may be utilized for securing the instrument within such pocket.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A writing instrument comprising:

(a) a tubular body having an upwardly extending upper end, a lower end having left and right sides, and a point end;

(b) left and right wings, each wing among the left and right wings having proximal and distal ends;

(c) mounting means interconnecting the left and right wings and the tubular body, the mounting means respectively positioning the left and right wings' proximal ends at the left and right sides of the tubular body's lower end, and the mounting means being adapted for respectively leftwardly and rightwardly extending the left and right wings' distal ends, and for arranging the tubular body, the left wing, and the right wing in an inverted "T" configuration; and (d) scribing means operatively associated with the tubular body's point end, wherein the mounting means are further adapted for pivoting movement of at least a first wing among the left and right wings from its leftwardly or rightwardly extended position to a downwardly extended position.

2. The writing instrument of claim 1 wherein the further adaptation for pivoting movement comprises at least a first hinge.

3. The writing instrument of claim 2 further comprising left and right hinges, said hinges comprising the at least first hinge.

4. The writing instrument of claim 3 further comprising means for resisting downward pivoting movement of the left and right wings, said means being connected operatively to the tubular body.

5. The writing instrument of claim 4 wherein the downward pivot resisting means comprise a plurality of snap fasteners.

6. The writing instrument of claim 1 wherein the scribing means comprise a drawing implement selected from the group consisting of fixed ballpoint pen assemblies, mechanically extendable and retractable ballpoint pen assemblies, fixed felt tip pen assemblies, mechanically extendable and retractable felt tip pen assemblies, fixed graphite pencil assemblies, and mechanical pencil assemblies.

7. The writing instrument of claim 1 wherein the scribing means comprise a cam and compression spring actuated extendable and retractable ballpoint pen assembly.

8. The writing instrument of claim 7 wherein the tubular body has an end opposite the point end, and wherein the cam and compression spring actuated extendable and retractable ballpoint pen assembly further comprises a click button extending from said opposite end.

* * * * *